US010695653B2

(12) United States Patent
Flowers

(10) Patent No.: US 10,695,653 B2
(45) Date of Patent: Jun. 30, 2020

(54) SNOWDECK WITH IMPROVED CONTROL

(71) Applicant: Gregory Scott Flowers, Fenton, MI (US)

(72) Inventor: Gregory Scott Flowers, Fenton, MI (US)

( * ) Notice: Subject to any disclaimer, the term of this patent is extended or adjusted under 35 U.S.C. 154(b) by 0 days.

(21) Appl. No.: 16/369,357

(22) Filed: Mar. 29, 2019

(65) Prior Publication Data

US 2019/0299081 A1 Oct. 3, 2019

Related U.S. Application Data

(60) Provisional application No. 62/650,145, filed on Mar. 29, 2018.

(51) Int. Cl.
*A63C 5/06* (2006.01)
*A63C 5/03* (2006.01)

(52) U.S. Cl.
CPC ..... *A63C 5/06* (2013.01); *A63C 5/03* (2013.01); *A63C 2203/42* (2013.01); *A63C 2203/46* (2013.01); *A63C 2203/54* (2013.01)

(58) Field of Classification Search
CPC ..... A63C 5/06; A63C 5/03; A63C 2203/42; A63C 2203/46; A63C 2203/54
USPC ..... 280/607
See application file for complete search history.

(56) References Cited

U.S. PATENT DOCUMENTS

| | | | | |
|---|---|---|---|---|
| 3,802,714 | A * | 4/1974 | Freegard | A63C 5/033 280/607 |
| 6,481,725 | B2 * | 11/2002 | Chou | A63C 5/03 280/14.21 |
| 6,773,021 | B2 * | 8/2004 | Breuer | A63C 5/03 280/14.21 |
| 9,717,976 | B2 * | 8/2017 | Elphick | A63C 5/031 |
| 9,981,178 | B1 * | 5/2018 | Huynh | A63C 5/075 |
| 2003/0193168 | A1 * | 10/2003 | Chou | A63C 5/02 280/607 |
| 2018/0221744 | A1 * | 8/2018 | Ball | A63C 9/007 |

* cited by examiner

*Primary Examiner* — John D Walters
(74) *Attorney, Agent, or Firm* — Howard & Howard Attorneys PLLC

(57) ABSTRACT

A gliding apparatus for use in snow is provided. The gliding apparatus may include a riding platform, the riding platform having a top surface to support a rider's feet and a bottom surface. The gliding apparatus may also include a snow ski, a first mounting device and a second mounting device, each positioned between the riding platform and the snow ski and each having a top portion and a bottom portion. The bottom portion of the first mounting device is pivotably coupled about a first axis to the snow ski and the bottom portion of the second mounting device is pivotably coupled about a second axis to the snow ski. The top portion of the first mounting device is pivotably coupled to the riding platform about a third axis and the top portion of the second mounting device is pivotably coupled to the riding platform about a fourth axis.

20 Claims, 7 Drawing Sheets

SNOWDECK WITH IMPROVED CONTROL

RELATED APPLICATION

The present application claims the benefits of U.S. Provisional Patent Application No. 62/650,145 filed on Mar. 29, 2018, the entire disclosure of which is hereby incorporated by reference.

BRIEF DESCRIPTION OF THE DRAWINGS

Advantages disclosed herein will be readily appreciated as the same becomes better understood after reading the subsequent description taken in connection with the accompanying drawings.

DETAILED DESCRIPTION

Figure 1:
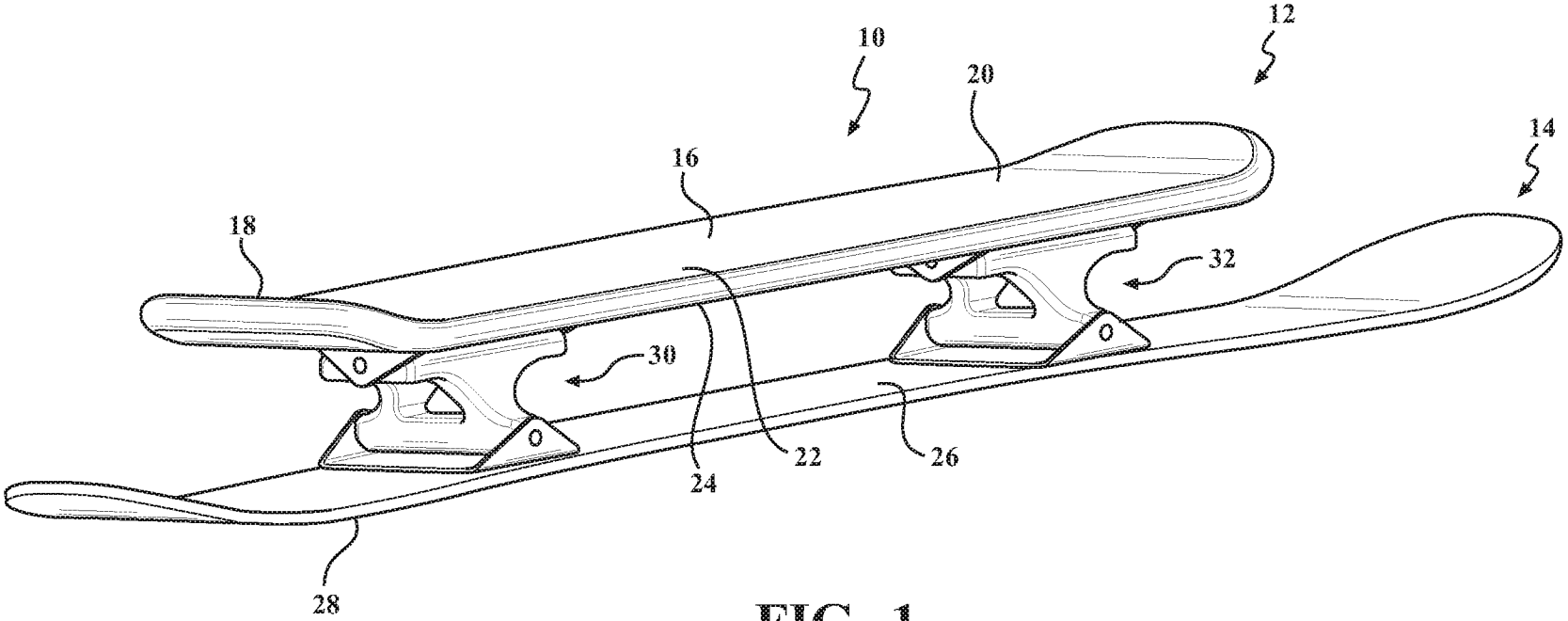
FIGS. 1-3 are perspective views of a gliding apparatus according to one example.

With reference to the drawings, wherein like numerals are used to designate like structure throughout the several views, a gliding apparatus 10 is shown in FIG. 1. It is the main object of the present disclosure to provide a skateboard and snow ski arrangement, which enables the user to use the riding platform 12 in the style of a skateboard in conjunction with a snow ski 14 for sliding over snow. As such, the gliding apparatus 10 is shown as a snowdeck in FIG. 1.

As shown in FIG. 1, the gliding apparatus 10 may comprise a riding platform 12 and a snow ski 14. The riding platform 12 may be styled in the form of a skateboard. Thus, the riding platform 12 may include an intermediate portion 16 between a pair of upturned end surfaces 18, 20. The riding platform 12 may have a top surface 22 to support a rider's feet. The riding platform 12 may also include a bottom surface 24 on the opposite side of the top surface 22, the bottom surface 24 generally facing a top surface 26 of the snow ski 14 to which the riding platform 12 is coupled. The riding platform 12 may be formed of a variety of materials, such as wood or composites. The riding platform 12 may be alternatively configured as a longboard. In certain configurations, the end surfaces need not be upturned, i.e., the top surface of the riding platform may be essentially planar.

The snow ski 14 may have various shapes and sizes, depending on the style preference of the rider. For example, a bottom surface 28 of the snow ski 14 may be substantially planar or arched for sliding over snow. The bottom surface 28 of the snow ski may include a low-friction material.

Figure 2:
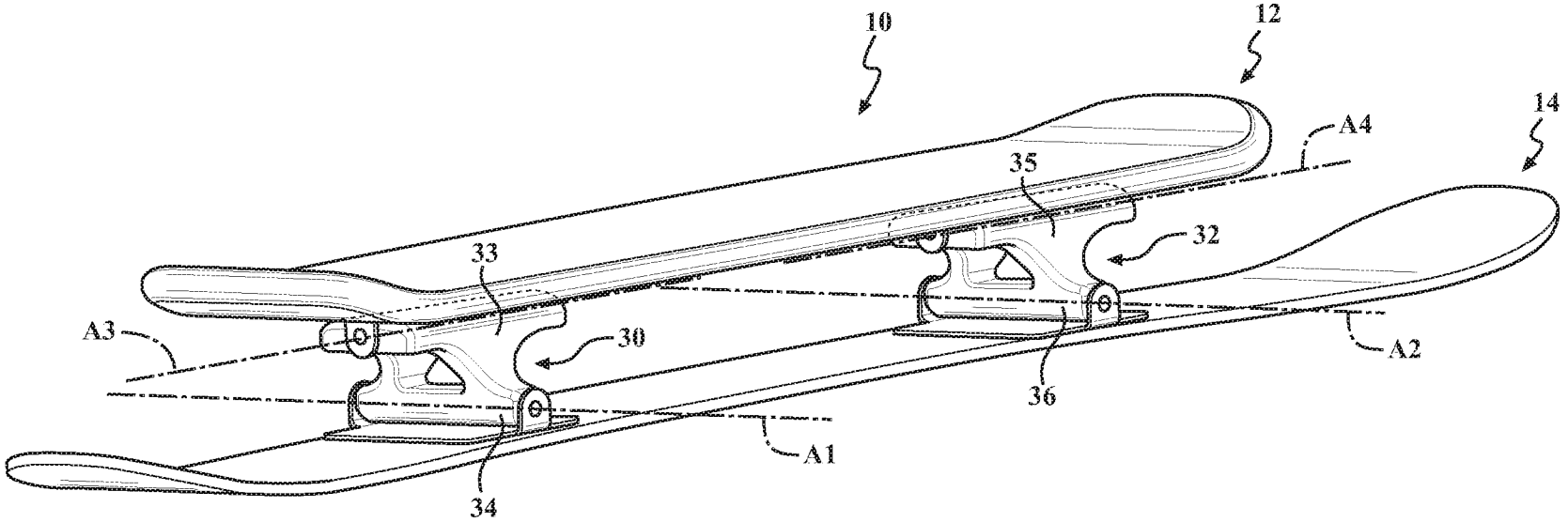
Figure 3:
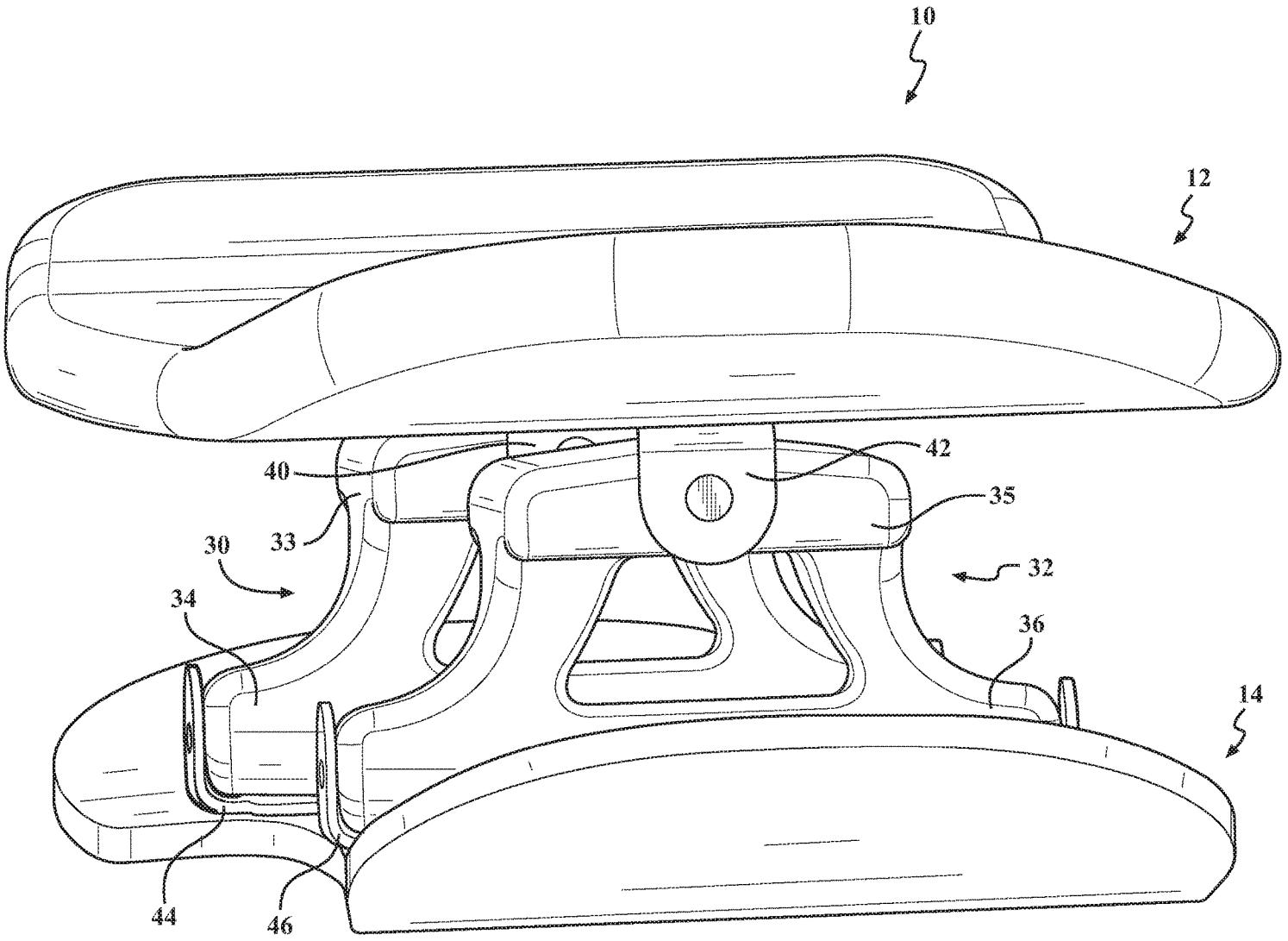

Referring to FIGS. 2 and 3, the gliding apparatus 10 may further comprise a first mounting device 30 and a second mounting device 32. The first mounting device 30 and the second mounting device 32 are configured for being positioned between the riding platform 12 and the snow ski 14. It is contemplated that more than two, or only one mounting device may be used. While only the first mounting device 30 is described in detail, it should be appreciated that the second mounting device 32 may have the same configuration or a different configuration from the first mounting device 30.

As shown in FIG. 2, each of the first and second mounting devices 30, 32 have a top portion 33, 35 and a bottom portion 34, 36 opposite the top portion 33, 35. The bottom portion 34 of the first mounting device 30 may be pivotably coupled about a first axis A1 to the snow ski 14. The bottom portion 36 of the second mounting device 32 may be pivotably coupled about a second axis A2 to the snow ski 14. In certain configurations, the first and second axes A1, A2 are generally parallel to one another; however, other arrangements are also contemplated. The first mounting device 30 and/or the second mounting device 32 may be a molded, one-piece, component. The first and/or second mounting devices 30, 32 may comprise plastic and/or metal. In certain configurations, the first and second mounting devices 30, 32 may comprise an elastomer to provide shock-absorbance to the gliding apparatus.

Also shown in FIG. 2, the top portion 33 of the first mounting device 30 is pivotably coupled to the riding platform 12 about a third axis A3 and the top portion 35 of the second mounting device 32 being pivotably coupled to the riding platform 12 about a fourth axis A4. The third axis A3 and the fourth axis A4 may be generally collinear with one another.

In certain aspects of the gliding apparatus 10, the mounting devices 30, 32 allow the riding platform 12 to pivot relative to the first and second mounting devices 30, 32. For example, the riding platform 12 may pivot relative to axes A1 and A2 and relative to axes A3 and A4. The mounting devices 30, 32 may also restrict some movement of the riding platform 12 relative to the snow ski 14. For instance, in one aspect of the gliding apparatus 10, the riding platform 12 is prevented from substantially rotating in a lateral plane relative to the snow ski 14. As such, the mounting devices 30, 32 allow for improved flexibility and control of the gliding apparatus 10 during use.

Referring to FIG. 3, the gliding apparatus 10 may further comprise a first platform bracket 40 and a second platform bracket 42. Each of the first and second platform brackets 40, 42 being mounted to the bottom surface 24 of the riding platform 12, using bolts, adhesive, screws or other fastening techniques. The first platform bracket 40 may be pivotably coupled to the top portion 33 of the first mounting device 30 and the second platform bracket 42 may be pivotably coupled to the top portion 35 of the second mounting device 32 as will be described below.

Also shown in FIG. 3, the gliding apparatus 10 may also include a first ski bracket 44 and a second ski bracket 46, each of the first and second ski brackets 44, 46 being mounted to the top surface 26 of the snow ski 14. Each of the first and second ski brackets 44, 46 may be mounted to the top surface of the snow ski 14 using bolts, adhesive, screws or other fastening techniques. The first ski bracket 44 may be pivotably coupled to the bottom portion 34 of the first mounting device 30, and the second ski bracket 46 may be pivotably coupled to the bottom portion 36 of the second mounting device 32 as will be described below.

The platform brackets 40, 42 and ski brackets 44, 46 may each have a different configuration, and may be formed from suitable materials to provide the requisite strength yet maintain the lightweight nature of the gliding apparatus 10.

Figure 4:
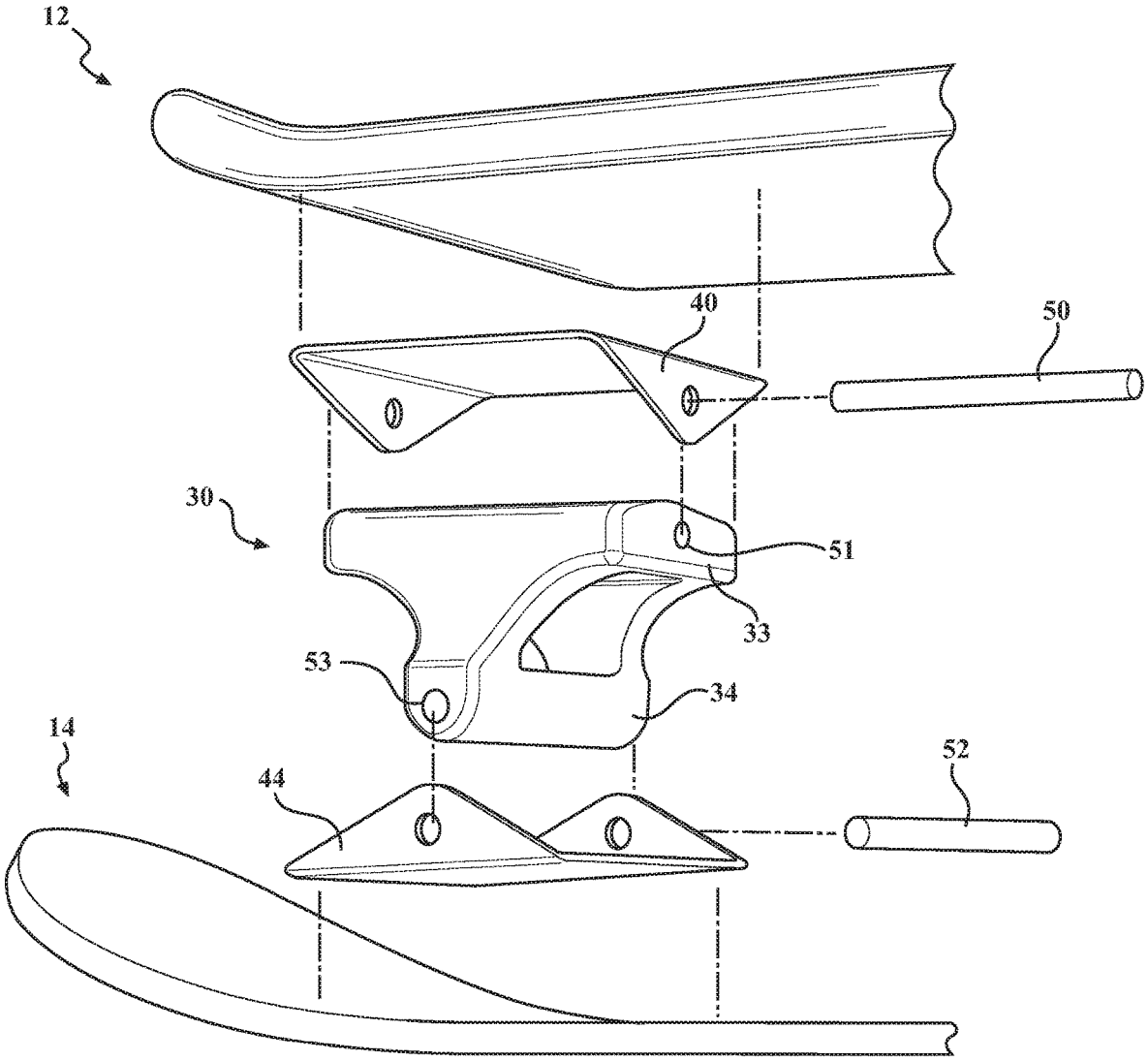
FIG. 4 is a partially-exploded perspective view of a portion of the gliding apparatus of FIGS. 1-3.
Figure 5:
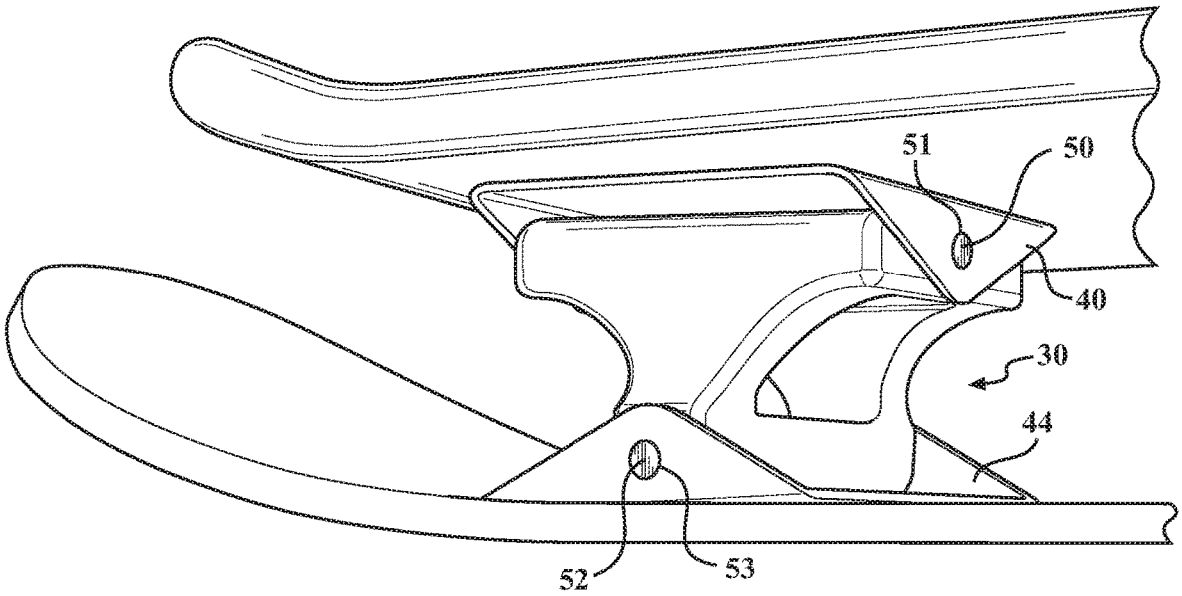
FIG. 5 is a partial perspective view of a portion of the gliding apparatus of FIGS. 1-3.
Figure 6:
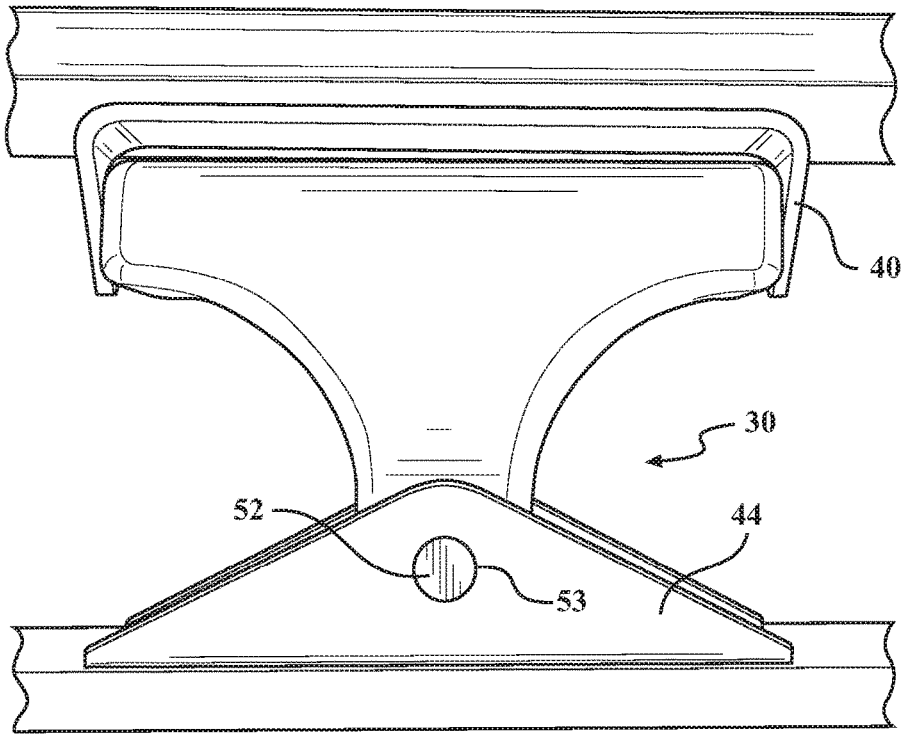
FIG. 6 is a side view of a portion of the first mounting device of FIGS. 1-4.

As shown in FIG. 4, the gliding apparatus 10 may further comprise a first rod 50, wherein the top portion 33 of the first mounting device 30 defining recess 51, with the first rod 50 being disposed in the recess 51 of the first mounting device 30, with the first mounting device 30 being pivotably coupled to the first platform bracket 40 about the first rod 50. The first rod 50 may have various cross-sections, such as a circular or non-circular cross section. The first rod 50 may also comprise various materials, such as metal or polymeric materials. FIGS. 5 and 6 illustrate views of the gliding apparatus 10, wherein the first rod 50 is disposed in the recess 51. The first rod 50 may be secured to the first mounting device 30 and/or the first platform bracket 40 using various fasteners, clips, welding, etc.

Also shown in FIG. 4, the gliding apparatus 10 may further comprise a second rod 52, wherein the bottom portion 34 of the first mounting device 30 comprises a recess 53, with the second rod 52 being disposed in the recess 53 of the first mounting device 30, with the first mounting device 30 being pivotably coupled to the first ski bracket 44 about the second rod 52. The second rod 52 may be secured to the first mounting device 30 and/or the first ski bracket 44 using various fasteners, clips, welding, etc. Additionally, the second rod 52 may have various cross-sections, such as a circular or non-circular cross section. The second rod 52 may also comprise various materials, such as metal or polymeric materials.

In a similar fashion, the gliding apparatus 10 may comprise a third and fourth rod (not shown), wherein the top portion 35 and the bottom portion 36 of the second mounting device 32 each comprise a recess (not shown), with the third rod being disposed in the recess of the top portion 35 of the second mounting device 32 and the fourth rod being disposed in the recess of the bottom portion 36 of the second mounting device 32. Accordingly, the second mounting device 32 may be pivotably coupled to the second platform bracket 42 and the second ski bracket 46 about the third rod and the fourth rod, respectively. The third rod may be secured to the second mounting device 32 and/or the second platform bracket 42 using various fasteners, clips, welding, etc. Similarly, the fourth rod may be securing to the second mounting device 32 and/or the second ski bracket 46 using various fasteners, clips, welding, etc.

Figure 7:
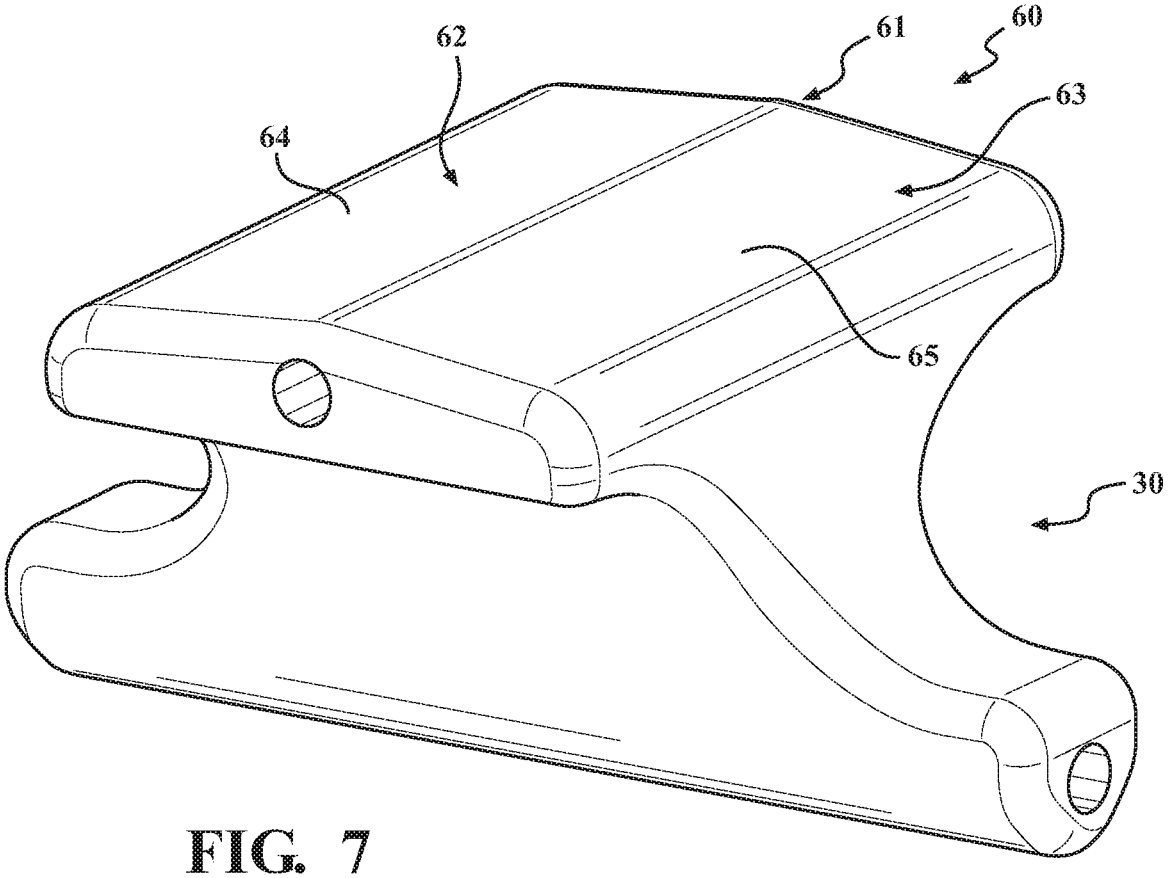
FIG. 7 is a perspective view of the first mounting device of the gliding apparatus of FIG. 1.

Referring to FIG. 7, the top portion 33 of the first mounting device 30 may further comprise a rocker surface 60. The rocker surface 60 may have a central region 61 that generally bisects the rocker surface 60. The central region 61 may be generally parallel with a longitudinal axis of the riding platform 12. The rocker surface 60 may further comprise a first section 62 and second section 63 on opposite sides of the central region, with the first and second sections 62, 63 being below the central region 61. The first section 62 corresponds to a first rocker side surface 64 which may generally extend at an angle relative to the central region 61. In other words, the first rocker side surface 64 may slope downwardly away from the central region 61. Similarly, the second section corresponds to a second rocker side surface 65 may generally extend at an angle relative to the central region 61. In other words, the second rocker side surface 65 may generally slope downwardly away from the central region 61. Thus, the rocker surface 60 may exhibit a generally v-shaped configuration. During operation, the first and second sections 62, 63 may periodically contact the underside of the platform brackets as the riding platform pivots about axes A3 and A4.

Figure 8:
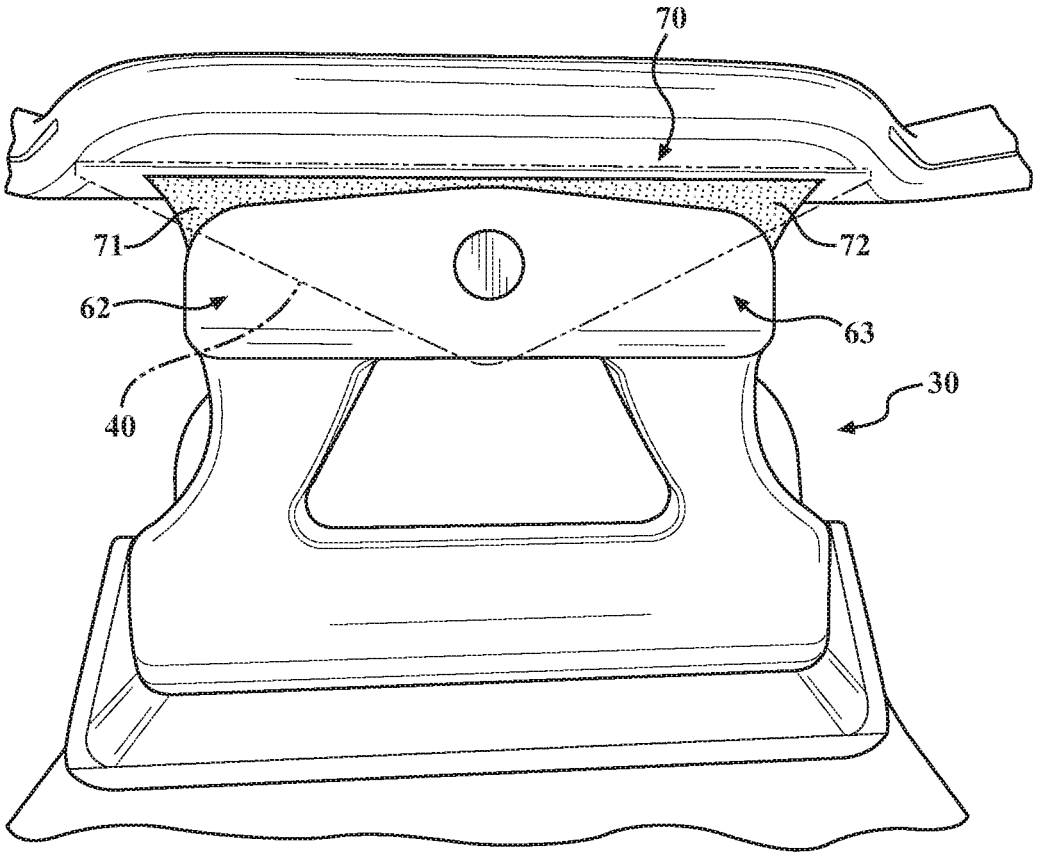
FIG. 8 is a front view of the gliding apparatus of FIGS. 1-3, with a damping member shown.

As shown in FIG. 8, the gliding apparatus 10 may optionally further include a damper member 70 positioned between at least one of the first and second sections 62, 63 of the rocker surface 60 of the first mounting device 30 and the first platform bracket 40. In certain configurations, the damper member 70 may take the form of a first damper member 71 coupled to the first section 62 of the rocker surface 60 and a second damper member 72 coupled to the second section 63 of the rocker surface 60, the first and second damper members 71, 72 configured to absorb energy when the riding platform 12 is pivoted about the third and fourth axes A3, A4 (shown in FIG. 2). In certain configurations, the damper member 70 is configured to contact a portion of the bottom surface 24 of the riding platform 12 and a portion of the rocker surface 60 when the riding platform 12 is pivoted relative to the snow ski 14. In other configurations, the damper member 70 is configured to contact a portion of the first platform bracket 40 and a portion of the rocker surface 60 when the riding platform 12 is pivoted relative to the snow ski 14. The damper member 70 may have different shapes and sizes, such as being in the shape of a polygon not longer than the rocker surface.

The damper member 70 and, furthermore, the first or second damper members 71, 72 may comprise a foam, rubber, or other vibration dampening material. Additionally, the damper member 70 may comprise a vibration dampening material based on a dampening preference. For example, if a higher dampening preference is desired, the damper member 70 may comprise a vibration dampening material with a lower Young's modulus. Similarly, if a lower dampening preference is desired, the damper member 70 may comprise a vibration dampening material with a higher Young's modulus.

It should be noted that the gliding apparatus 10 may also include a damper member similar to the damper member 70 between a rocker surface of the second mounting device 32 and the second platform bracket 42. Furthermore, the gliding apparatus 10 may include a damper member similar to the damper member 70 between the bottom portions 34, 36 of the first and second mounting devices 30, 32 and the first and second ski brackets 44, 46, respectively.

A method of assembling the gliding apparatus 10 for use in snow is also contemplated. The method includes a step of positioning the first and second mounting devices 30, 32 between the riding platform 12 and the snow ski 14. The method also includes a step of pivotably coupling the bottom portion 34 of the first mounting device 30 to the snow ski 14 about the first axis A1 and a step of pivotably coupling the bottom portion 36 of the second mounting device 32 to the snow ski 14 about the second axis A2, wherein the first axis A1 and the second axis A2 are generally parallel to one another. The method also includes a step of pivotably coupling the top portion 33 of the first mounting device 30 to the riding platform 12 about the third axis A3 and a step of pivotably coupling the top portion 35 of the second mounting device 32 to the riding platform 12 about the fourth axis A4, wherein the third axis A3 and the fourth axis A4 are generally collinear with one another.

In some instances, the method may also include a step of coupling the first ski bracket 44 and the second ski bracket 46 to the top surface 26 of the snow ski 14. In such instances, the step of pivotably coupling the bottom portion 34 of the first mounting device 30 to the snow ski 14 includes a step of pivotably coupling the bottom portion 34 of the first mounting device 30 to a first ski bracket 44. Additionally, in such instances, the step of pivotably coupling the bottom portion 36 of the second mounting device 32 to the snow ski 14 includes a step of pivotably coupling the bottom portion 36 of the second mounting device 32 to the second ski bracket 46.

In some instances, the method may also include a step of coupling the first platform bracket 40 and the second platform bracket 42 to the bottom surface 24 of the riding platform 12. In such instances, the step of pivotably coupling the top portion 33 of the first mounting device 30 to the riding platform 12 includes a step of pivotably coupling the top portion 33 of the first mounting device 30 to the first platform bracket 40. Additionally, in such instances, the step of pivotably coupling the top portion 35 of the second mounting device 32 to the riding platform 12 includes a step of pivotably coupling the top portion 35 of the second mounting device 32 to the second platform bracket 42.

The steps of the above-described method of assembling the gliding apparatus 10 may be ordered in any suitable fashion. For example, the step of pivotably coupling the bottom portion 36 of the second mounting device 32 to the snow ski 14 about the second axis A2 may occur prior to the step of pivotably coupling the bottom portion 34 of the first mounting device 30 to the snow ski 14 about the first axis A1.

It is contemplated that certain components of the gliding apparatus 10 may be provided to users so that they may assemble the gliding apparatus 10 with their own riding platform 12 and snow ski 14. For such a preference, a mounting system is provided for assembling the gliding apparatus 10 for use in snow. The mounting system may include any of the components described above, but may optionally the riding platform 12 or the snow ski 14. For instance, the mounting system may include the first mounting device 30 and the second mounting device 21. The mounting system may also include the first ski bracket 44 and the second ski bracket 46, each of the first and second ski brackets 44, 46 being configured for being mounted to the top surface 26 of a snow ski 14. The mounting system may also include the first platform bracket 40 and the second platform bracket 42, each of the first and second platform brackets 40, 42 being configured for being mounted to the bottom surface 24 of the riding platform 12. In some instances, the mounting system may include one or more damper members 70. For example, the mounting system may include one or more first and second damper members 71, 72, which are configured to be coupled to the rocker surface 60 of the first and/or second mounting devices 32.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several examples have been discussed in the foregoing description. However, the example discussed herein are not intended to be exhaustive or limit the disclosure to any particular form. The terminology which has been used is intended to be in the nature of words of description rather than of limitation. Many modifications and variations are possible in light of the above teachings and the disclosure may be practiced otherwise than as specifically described.

The invention claimed is:

1. A gliding apparatus for use in snow, the gliding apparatus comprising:

a riding platform having a top surface to support a rider's feet and a bottom surface;

a snow ski configured to slide over snow;

a first mounting device and a second mounting device, each positioned between the riding platform and the snow ski and each having a top portion and a bottom portion, wherein:

the bottom portion of the first mounting device is pivotably coupled about a first axis to the snow ski and the bottom portion of the second mounting device is pivotably coupled about a second axis to the snow ski, with the first and second axes being generally parallel to one another; and the top portion of the first mounting device is pivotably coupled to the riding platform about a third axis and the top portion of the second mounting device is pivotably coupled to the riding platform about a fourth axis, with the third axis and the fourth axis being generally collinear with one another; and wherein the riding platform is capable of pivoting relative to the first and second mounting device.

2. The gliding apparatus of claim 1, further comprising a first platform bracket and second platform bracket, each of the first and second platform brackets being mounted to the bottom surface of the riding platform, the first platform bracket being pivotably coupled to the top portion of the first mounting device, and the second platform bracket being pivotably coupled to the top portion of the second mounting device.

3. The gliding apparatus of claim 2, further comprising a first rod, wherein the top portion of the first mounting device comprises a recess, with the first rod being disposed in the recess, with the first mounting device being pivotably coupled to the first platform bracket about the first rod.

4. The gliding apparatus of claim 3, wherein the top portion of the first mounting device further comprises a rocker surface, the rocker surface comprising a central region generally parallel with a longitudinal axis of the riding platform and a first and second sections on opposite sides of the central region, with the first and second sections being below the central region.

5. The gliding apparatus of claim 4, further comprising a damper member positioned between at least one of the first and second sections of the rocker surface and the first platform bracket.

6. The gliding apparatus of claim 5, wherein the damper member comprises a foam.

7. The gliding apparatus of claim 5, wherein the damper member is configured to contact a portion of the bottom surface of the riding platform and a portion of the rocker surface when the riding platform is pivoted relative to the snow ski.

8. The gliding apparatus of claim 5, wherein the damper member is configured to contact a portion of the first platform bracket and a portion of the rocker surface when the riding platform is pivoted relative to the snow ski.

9. The gliding apparatus of claim 4, further comprising a first damper member coupled to the first section of the rocker surface and a second damper member coupled to the second section of the rocker surface, the first and second damper members configured to absorb energy when the riding platform is pivoted about the first or second axes.

10. The gliding apparatus of claim 9, wherein the first or second damper members comprise a foam.

11. The gliding apparatus of claim 3, wherein the top portion of the second mounting device further comprises a rocker surface, the rocker surface comprising a central region generally parallel with a longitudinal axis of the riding platform and a first and second sections on opposite sides of the central region, with the first and second sections being at least partially below the central region.

12. The gliding apparatus of claim 1, further comprising a first ski bracket and a second ski bracket, each of the first and second ski brackets being mounted to the top surface of the snow ski, the first ski bracket being pivotably coupled to the bottom portion of the first mounting device, and the second ski bracket being pivotably coupled to the bottom portion of the second mounting device.

13. The gliding apparatus of claim 12, further comprising a second rod, wherein the bottom portion of the first mounting device comprises a recess, with the second rod being disposed in the recess, with the first mounting device being pivotably coupled to the first ski bracket about the second rod.

14. The gliding apparatus of claim 1, wherein the first mounting device is a molded, one-piece, component.

15. The gliding apparatus of claim 1, further comprising a tether secured to at least one of the riding platform, the first mounting device, and the second mounting device.

16. The gliding apparatus of claim 1, wherein the riding platform is configured as a skateboard platform.

17. A method of assembling a gliding apparatus for use in snow, the gliding apparatus including a riding platform, a snow ski configured to slide over snow, a first mounting device and a second mounting device, wherein the riding platform includes a top surface to support a rider's feet and a bottom surface, and wherein the first mounting device and the second mounting device each include a top portion and a bottom portion, the method comprising steps of:

positioning the first and second mounting devices between the riding platform and the snow ski;

pivotably coupling the bottom portion of the first mounting device to the snow ski about a first axis;

pivotably coupling the bottom portion of the second mounting device to the snow ski about a second axis, wherein the first axis and the second axis are generally parallel to one another;

pivotably coupling the top portion of the first mounting device to the riding platform about a third axis; and pivotably coupling the top portion of the second mounting device to the riding platform about a fourth axis, wherein the third axis and the fourth axis are generally collinear with one another.

18. The method of claim 17, wherein the method further comprises a step of coupling a first ski bracket and a second ski bracket to the top surface of the snow ski;

wherein the step of pivotably coupling the bottom portion of the first mounting device to the snow ski comprises a step of pivotably coupling the bottom portion of the first mounting device to the first ski bracket; and wherein the step of pivotably coupling the bottom portion of the second mounting device to the snow ski comprises a step of pivotably coupling the bottom portion of the second mounting device to the second ski bracket.

19. The method of claim 17, wherein the method further comprises a step of coupling a first platform bracket and a second platform bracket to the bottom surface of the riding platform;

wherein the step of pivotably coupling the top portion of the first mounting device to the riding platform comprises a step of pivotably coupling the top portion of the first mounting device to the first platform bracket; and wherein the step of pivotably coupling the top portion of the second mounting device to the riding platform comprises a step of pivotably coupling the top portion of the second mounting device to the second platform bracket.

20. A mounting system for assembling a gliding apparatus for use in snow, said mounting system comprising:

a mounting device having a top portion and a bottom portion, each of the top portion and the bottom portion comprising a recess, and wherein the top portion of the mounting device further comprises a rocker surface, the rocker surface comprising a central region and first and second sections on opposite sides of the central region, with the first and second sections being below the central region;

a first rod configured for being disposed within the recess of the bottom portion;

a second rod configured for being disposed within the recess of the top portion;

a ski bracket configured for being mounted to a top surface of a snow ski and for being pivotably coupled to the bottom portion of the mounting device about the first rod; and a platform bracket configured for being mounted to a bottom surface of a riding platform and for being pivotably coupled to the top portion of the mounting device about the second rod.

* * * * *